United States Patent [19]

Hanbicki

[11] 4,308,431

[45] Dec. 29, 1981

[54] SPEAKER WITH LOW MASS DRIVER

[76] Inventor: Richard B. Hanbicki, P.O. Box 432, Broad & Grove St., Three Bridges, N.J. 08887

[21] Appl. No.: 142,423

[22] Filed: Apr. 21, 1980

[51] Int. Cl.[3] ..... H04R 19/02

[52] U.S. Cl. ..... 179/111 R

[58] Field of Search ..... 179/111 R

[56] References Cited

U.S. PATENT DOCUMENTS 1,193,184 8/1916 Plecher ..... 179/111 R 1,767,656 6/1930 Edelman ..... 179/111 R

*Primary Examiner*—George G. Stellar

*Attorney, Agent, or Firm*—Weinstein & Sutton

[57] ABSTRACT

Sound is created by imparting vibration to a thin membrane by means of a polar gas which is disturbed by changing electrostatic field concentrated within selected portions of the region occupied by said gas whose molecules align themselves along the field lines of the concentrated electrostatic field to impart vibration to the thin displaceable membrane and thereby create sound.

10 Claims, 3 Drawing Figures

SPEAKER WITH LOW MASS DRIVER

BACKGROUND OF THE INVENTION

Speakers constitute the least efficient link in a sound reproduction system from the viewpoints of fidelity of the original sound and energy conversion efficiency. Amplifiers and preamplifiers are capable of amplifying input signals at distortion levels that are so minimal as to be substantially incapable of being detected by the human ear and over a frequency range which extends well beyond the range capable of being perceived by the human ear.

The input audio signals so amplified in a substantially distortion-free and noise-free manner (from the point of view of the human ear) are utilized to drive a speaker typically comprised of a low mass cone whose center is driven by a relatively high mass magnetically attractive armature member driven in a reciprocating manner by a magnetic field developed by a coil whose field strength varies in accordance with amplified audio signals. The armature is sluggish due to the moment of inertia resulting from its mass and introduces distortion into the sound generated by the vibrating cone. The conversion efficiency is also low due to the loss in energy which occurs in the conversion of electrical energy into mechanical energy. Electrostatic speakers of the solid state type also suffer from the same disadvantages. Both types of high quality speakers also have complicated designs and are expensive to manufacture.

SUMMARY OF THE INVENTION

A primary object of the present invention is to provide a speaker of simplified design which is capable of reproducing sound of high fidelity and which is significantly more efficient than present day speakers of the type described.

The present invention is comprised of a gas-tight enclosure containing a gas comprised of molecular particles capable of exhibiting a net electric charge, which particles are dispersed and oriented in a random fashion so that an effective zero net charge is maintained throughout the interior volume of the enclosure when the gas is not disturbed by an electric field. Gases suitable for use in the present invention are typically categorized as polar gases and include, but are not limited to: carbon dioxide, nitrous oxide, etc.

The enclosure preferably has a parallelepiped shape with two major faces thereof arranged in spaced parallel fashion. The interior surface of one major face is electrically conductive and has a large plurality of thin (pin-like) integral conductive projections extending from said conductive surface toward the remaining major face which is formed of a thin gauge membrane adapted to be displaced by the enclosed gas as the gas molecules undergo localized movement. One surface of the membrane is conductive. A changing electric field is coupled across the aforesaid conductive surfaces. The conductive pins concentrate the electric field lines in the region between the tips of the pins and the membrane. The gas molecules capable of exhibiting a net charge are influenced by the concentrated electric field to shift from their normally random distribution to become aligned with the field lines of the electric field resulting in the displacement of the membrane in the regions of each of the pins which in turn activate molecules in the ambient air adjacent to the exterior surface of the membrane which transmit the reproduced audible sound through space. The molecules resume their random distribution and orientation when the electric field collapses.

The gas is maintained at or below atomospheric conditions i.e. ambient pressure and temperature. A sensitive one-way pressure relief valve is arranged to open in the event that a pressure differential develops such that the pressure of the entrained gas is greater than the pressure of the surrounding atmosphere. However, the total nominal volume of the entrained gas normally remains substantially constant during operation since the molecules move from regions of weak field strength into regions of the intense electric field strength. The magnitude of the sound created is controlled by the strength of the electric field and the total surface area of the aforesaid major faces.

It is therefore one object of the present invention to provide a novel speaker which creates sound by imparting local disturbances to a gas, which disturbances impart movement to a displaceable membrane.

Another object of the present invention is to provide a novel speaker of the character described hereinabove wherein the aforesaid local disturbances are obtained by means of an array of conductive pins which concentrate the electric field in the aforesaid regions of the local disturbances.

BRIEF DESCRIPTION OF THE DRAWING

The above as well as other objects of the invention will become apparent upon a consideration of the accompanying description and drawing, in which.

DETAILED DISCUSSION OF PREFERRED EMBODIMENT OF THE INVENTION

Figure 1:
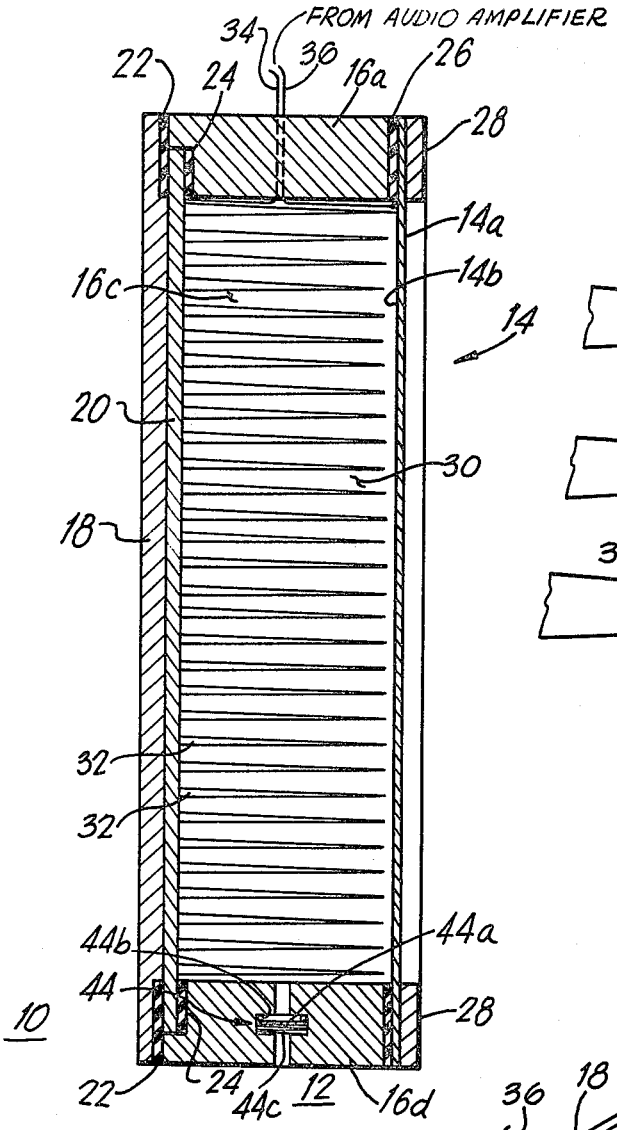
FIG. 1 is a sectional end view of a speaker embodying the principles of the present invention.
Figure 3:
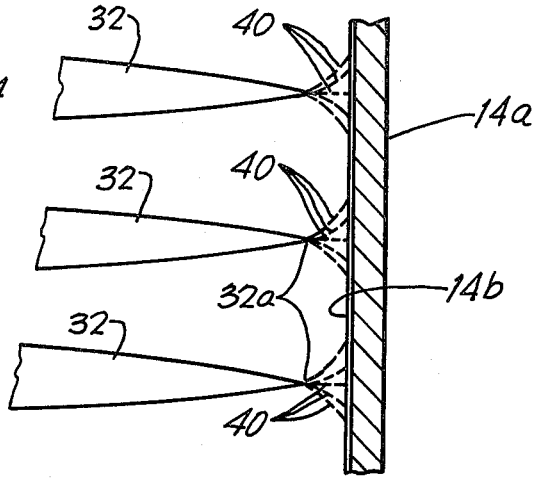
FIG. 3 is an enlarged view of a portion of the speaker of FIG. 1 showing the electric field developed by the speaker.
Figure 2:
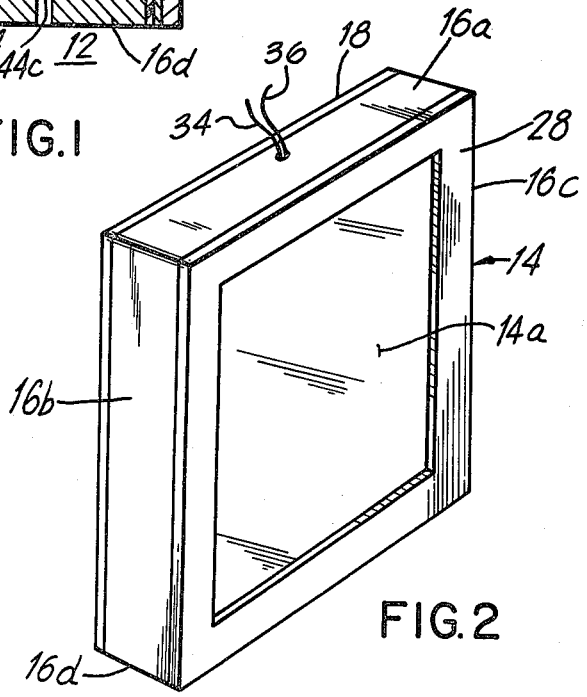
FIG. 2 shows a front perspective view of the speaker of FIG. 1.

FIGS. 1 through 3 show a speaker 10 embodying the principles of the present invention and comprised of enclosure 12 including front and rear surfaces 14 and 18, comprising the major faces of enclosure 12; top and bottom walls 16*a*, 16*d* and side walls 16*b* and 16*c*. FIG. 1 shows sidewalls 16*a* and 16*d* in section and sidewall 16*c* in plan view, sidewall 16*b* being removed to expose the interior structure of speaker 10.

A conductive plate 20 is arranged along the interior side of rear surface 18. In order to provide an air-tight enclosure, a gasket 22 is positioned between rear wall or surface 18 and plate 20. A gasket 24 is positioned between sidewalls 16*a* to 16*d* and plate 20. An epoxy may be used in addition to or as an alternative to the gaskets 22 and 24.

A gasket 26 is positioned between front face 14 and sidewalls 16*a* to 16*d*. Front face 14 is comprised of a thin gauge plastic sheet 14*a* as Mylar, having a conductive coating 14*b* along the interior surface of sheet 14*a*. If desired, however, the conductive surface 14*b* may be arranged upon the exterior surface of sheet 14*a*. A frame 28 secures gasket 26 and the periphery of sheet 14*a* against sidewalls 16*a* to 16*d*. A suitable epoxy may be used with or as an alternative to gasket 26.

A large array 30 of conductive pins 32 integral with conductive plate 20 project away from plate 20 and towards sheet 14. Pins 32 are tapered, forming a sharp point 32*a* at their free ends. Pins 32 are preferably arranged in an array 30 comprising a regular matrix of equi-spaced rows and columns although other arrays may be utilized, if desired. For example, the rows and/or columns of the array may be more closely spaced towards the center of the major faces. Alternatively the pins 32 may be arranged to lie along imaginary circles of decreasing diameter and whose centers are coincident with the center of the major face and with one another. The diameters of the imaginary circles may be equispaced or increasingly closer together of farther apart in the center region of the major face.

Conductive leads 34 and 36 couple amplified electrical signals to plate 20 and conductive surface 14*b* which signals cause the sheet 20 and surface 14*b* to develop an electric field inside of the housing whose field strength changes which changes in the signal strength of the signal applied to leads 34 and 36. The electrical field is concentrated in the regions between the pin tips 32*a* and the portions of conductive surface 14*b* opposite the tips 32*a* as represented by the field lines 40 shown in FIG. 3. The electric field, which is highly concentrated in the region of tips 32*a*, diverges in a conical fashion and becomes more uniform at surface 14*b*. The gas entrained in housing 12 is preferably taken from the group of gases typically referred to as polar gases, which are characterized by incorporating molecules capable of exhibiting a net electrical charge different from zero. Such molecules are capable of exhibiting a dipole moment p where $p=qd$, q being the charge and d being the distance between charges. The dipole moment can be permanent or may be induced by the external field imposed upon the gas. Although the pressure may increase in the regions of concentrated electric field strength due to migration of the molecules into the regions of greater field strength, the pressure is reduced in the regions between the concentrated electric field region whereby the net internal pressure is unchanged.

In the absence of an electrical field, the molecules are distributed in a substantially random fashion and further so that the net electrical charge throughout the interior volume is zero. The molecules also undergo constant movement as a function of ambient temperature. This movement however has an insignificant effect upon the creation of sound in accordance with the present invention and may be ignored for purposes of understanding the present invention.

The molecules of the gas having positive and negative poles migrate from the regions where the field strength is weak towards the regions of concentrated electric field strength and align themselves antiparallel with the polarity of the electric field, positive poles being attracted toward more negative electric potential and negative poles toward more positive electric potential. The molecules move away from the regions of low field strength and tend to align themselves with the field lines shown in FIG. 3 representing maximum field strength. Since the pins 32 are stationary, the long string of aligned molecules imparts a force upon the displaceable membrane 14*a* at a rate which is a function of rate of change i.e. (frequency) of the amplified audio signal.

Each region of membrane 14*a* is displaced in a similar manner and, in turn, imparts vibration to the molecules in the air surrounding the exterior surface 14*a* of speaker 10, creating sound waves which are conveyed through the atmosphere. The sound produced by each of the multiplicity of displaced regions of membrane 14*a* is cumulative. A surface area of one foot square provides an adequate output. Obviously, speakers of larger surface area provide even greater loudness. Speaker efficiency is quite high since the driving means is a gas comprised of particles (molecules) of extremely low mass.

The one-way pressure sensitive relief valve 44 arranged in an opening of sidewall 16*d* is designed to open in the event that the pressure within enclosure 12 exceeds ambient pressure by a small predetermined amount to prevent the displaceable membrane 14*a* from being damaged. The disc 44*a* is urged against gasket 44*b* by helical spring 44*c*. If the interior pressure increases sufficiently, the gas causes disc 44*a* to move away from gasket 44*b* to equalize the interior and exterior pressures.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A speaker comprising a gas-tight enclosure containing a gas:

said enclosure having a pair of spaced substantially parallel faces each respectively having first and second conductive means for creating an electric field in the region between said first and second conductive means to disturb the random distribution of molecules in said gas disposed in said electric field;

said first conductive means being displaceable whereby disturbance of said gas by the electric field imparts vibration to said first conductive means, said vibration occuring at a rate which is a function of the rate of change of said electric field; and said second conductive means comprising means for concentrating said electric field at predetermined regions about the major faces of said first and second conductive means.

2. The speaker of claim 1 wherein said concentrating means comprises a plurality of conductive projections being electrically connected to said second conductive means and having their free ends arranged in close proximity to said first conductive means; and said projections being arranged in a predetermined array.

3. The speaker of claim 2 wherein said projections comprise a plurality of conductive pins.

4. The speaker of claim 3 wherein said pins are thin conductive members which taper to a point at their free ends.

5. The speaker of claim 2 wherein said conductive projections are joined to said second conductive means; and said second conductive means comprising a conductive sheet.

6. The speaker of claim 1 wherein said first conductive means comprise a thin membrane, a conductive coating provided on one surface of said membrane.

7. The speaker of claim 6 wherein said membrane is comprised of a thin plastic sheet.

8. The speaker of claim 7 wherein said sheet is comprised of Mylar.

9. The speaker of claim 8 wherein said membrane comprises one major face of said enclosure; and means for air-tightly sealing the peripheral portion of said membrane to said enclosure.

10. The speaker of claim 1 further comprising pressure sensitive relief valve means arranged along the periphery of said enclosure for relieving the internal pressure within said enclosure when the differential pressure between the interior and exterior of said enclosure reaches a predetermined threshold, to relieve and substantially equalize said interior and exterior pressures.

* * * * *